US011268268B2

(12) United States Patent
Lee et al.

(10) Patent No.: US 11,268,268 B2
(45) Date of Patent: Mar. 8, 2022

(54) METHOD FOR CLEANING DRAIN PIPE OF SINK AND CLEANING CONTAINER THEREFOR

(71) Applicant: LG HOUSEHOLD & HEALTH CARE LTD., Seoul (KR)

(72) Inventors: Ju-Ha Lee, Seoul (KR); Seung-Il Shin, Seoul (KR); In-Kee Yoo, Seoul (KR); Hyuk-Su Kwon, Seoul (KR); Min-Kyung Jo, Seoul (KR)

(73) Assignee: LG HOUSEHOLD & HEALTH CARE LTD., Seoul (KR)

( * ) Notice: Subject to any disclaimer, the term of this patent is extended or adjusted under 35 U.S.C. 154(b) by 0 days.

(21) Appl. No.: 16/761,725

(22) PCT Filed: Nov. 6, 2018

(86) PCT No.: PCT/KR2018/013415

§ 371 (c)(1),
(2) Date: May 5, 2020

(87) PCT Pub. No.: WO2019/088810

PCT Pub. Date: May 9, 2019

(65) Prior Publication Data

US 2020/0340224 A1 Oct. 29, 2020

(30) Foreign Application Priority Data

Nov. 6, 2017 (KR) ..... 10-2017-0146817
Nov. 7, 2017 (KR) ..... 10-2017-0147519

(51) Int. Cl.
*B08B 9/027* (2006.01)
*E03C 1/304* (2006.01)

(52) U.S. Cl.
CPC ..... *E03C 1/304* (2013.01); *B08B 9/027* (2013.01); *B08B 2209/027* (2013.01)

(58) Field of Classification Search
CPC .... B08B 9/027; B08B 2209/027; E03C 1/304
See application file for complete search history.

(56) References Cited

U.S. PATENT DOCUMENTS 3,471,064 A * 10/1969 Micallef ..... B05B 11/043 222/211
4,201,316 A * 5/1980 Klingaman ..... B05B 11/0078 222/136

(Continued)

FOREIGN PATENT DOCUMENTS

JP 7-33879 U 6/1995
JP 2002-356700 A 12/2002

(Continued)

*Primary Examiner* — Sharidan Carrillo
(74) *Attorney, Agent, or Firm* — Birch, Stewart, Kolasch & Birch, LLP

(57) ABSTRACT

The present invention relates to an aerosol spray for cleaning a drain with an excellent foam cleaning effect by spraying a drain cleaning composition to a drain hole and a drain of a sink, and the foamed cleaner can remain for a long time by spraying the drain cleaning composition in an aerosol or foam form to a sink filter, a drain hole and a drain, to maximize the cleaning effect. In addition, the present invention discloses a method for cleaning a drain of a sink comprising; (a) preparing a cleaner container comprising a first receiving part and a second receiving part in which a first agent and a second agent are received respectively; (b) mixing the first agent and the second agent each other; and (c) arranging the cleaner container in a drain inlet of a sink to inject a mixed foam cleansing agent released through an outlet of the cleaner container.

10 Claims, 10 Drawing Sheets

(56) References Cited

U.S. PATENT DOCUMENTS

| | | | | |
|---|---|---|---|---|
| 4,969,491 | A | 11/1990 | Kiplinger | |
| 6,479,444 | B1 * | 11/2002 | Porticos | C11D 1/94 510/195 |
| 2003/0028957 | A1 | 2/2003 | Kawai | |
| 2003/0171234 | A1 | 9/2003 | Ajmani et al. | |
| 2004/0026535 | A1 * | 2/2004 | Conway | C11D 17/041 239/433 |
| 2005/0282722 | A1 * | 12/2005 | McReynolds | C11D 17/041 510/302 |
| 2006/0276366 | A1 * | 12/2006 | Deljosevic | C11D 3/3956 510/302 |
| 2007/0253626 | A1 * | 11/2007 | Jeffrey | H04N 5/23241 382/232 |
| 2008/0276359 | A1 | 11/2008 | Morgan et al. | |
| 2010/0157723 | A1 * | 6/2010 | De La Vega | B65D 51/2885 366/162.2 |
| 2014/0203043 | A1 * | 7/2014 | Yamanaka | B65D 51/2821 222/81 |
| 2015/0065409 | A1 | 3/2015 | Ortmann et al. | |
| 2015/0275157 | A1 * | 10/2015 | Souter | C11D 3/365 510/296 |
| 2017/0225855 | A1 | 8/2017 | Lawson et al. | |

FOREIGN PATENT DOCUMENTS

| | | | |
|---|---|---|---|
| JP | 2008-150461 | A | 7/2008 |
| KR | 10-2000-0069481 | A | 11/2000 |
| KR | 10-2003-0014597 | A | 2/2003 |
| KR | 10-2013-0011346 | A | 1/2013 |
| KR | 20-0476070 | Y1 | 1/2015 |
| KR | 10-1505593 | B1 | 3/2015 |
| KR | 10-2016-0012490 | A | 2/2016 |
| WO | WO 98/27288 | A2 | 6/1998 |

* cited by examiner

【FIG. 1】
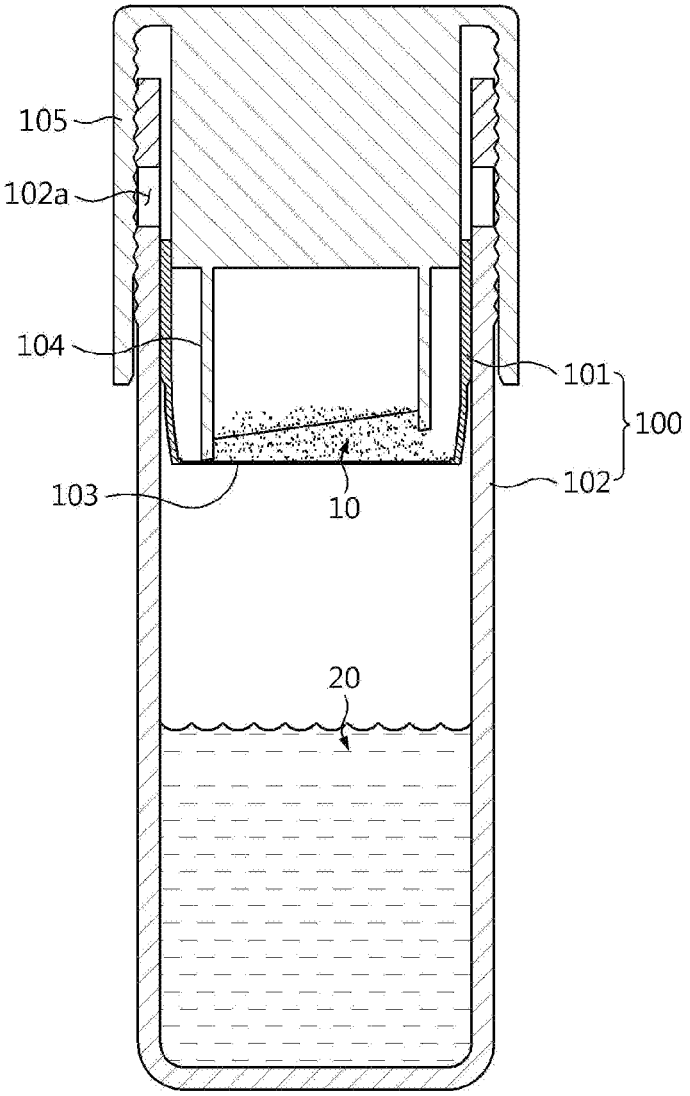

【FIG. 2】
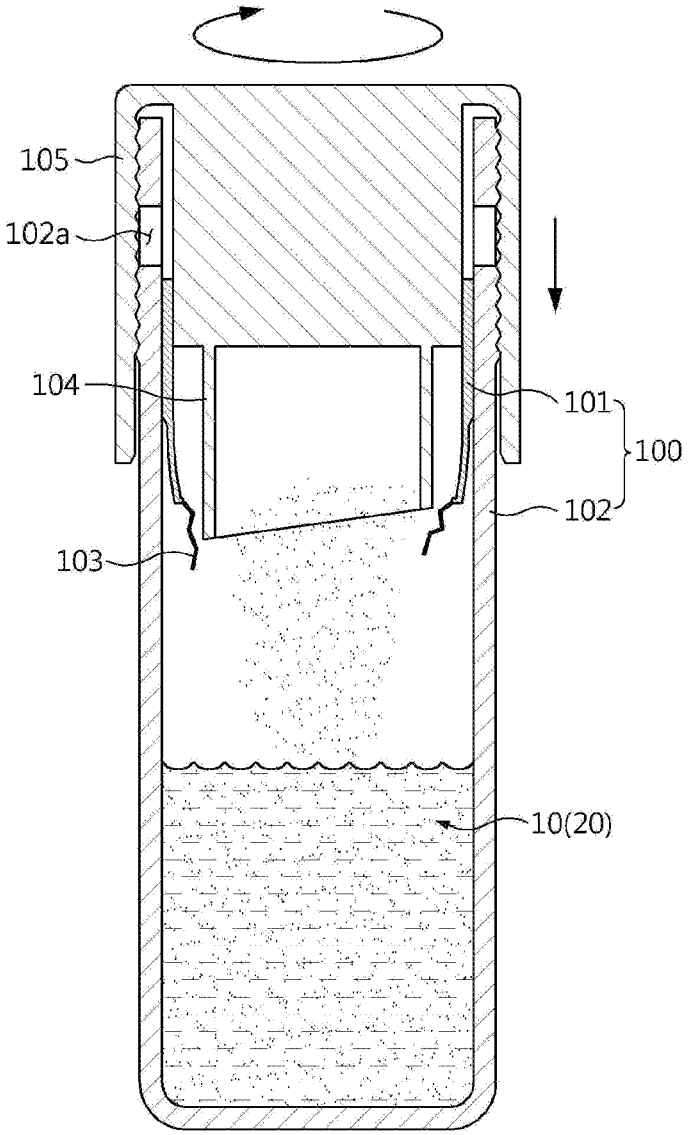

【FIG. 3】
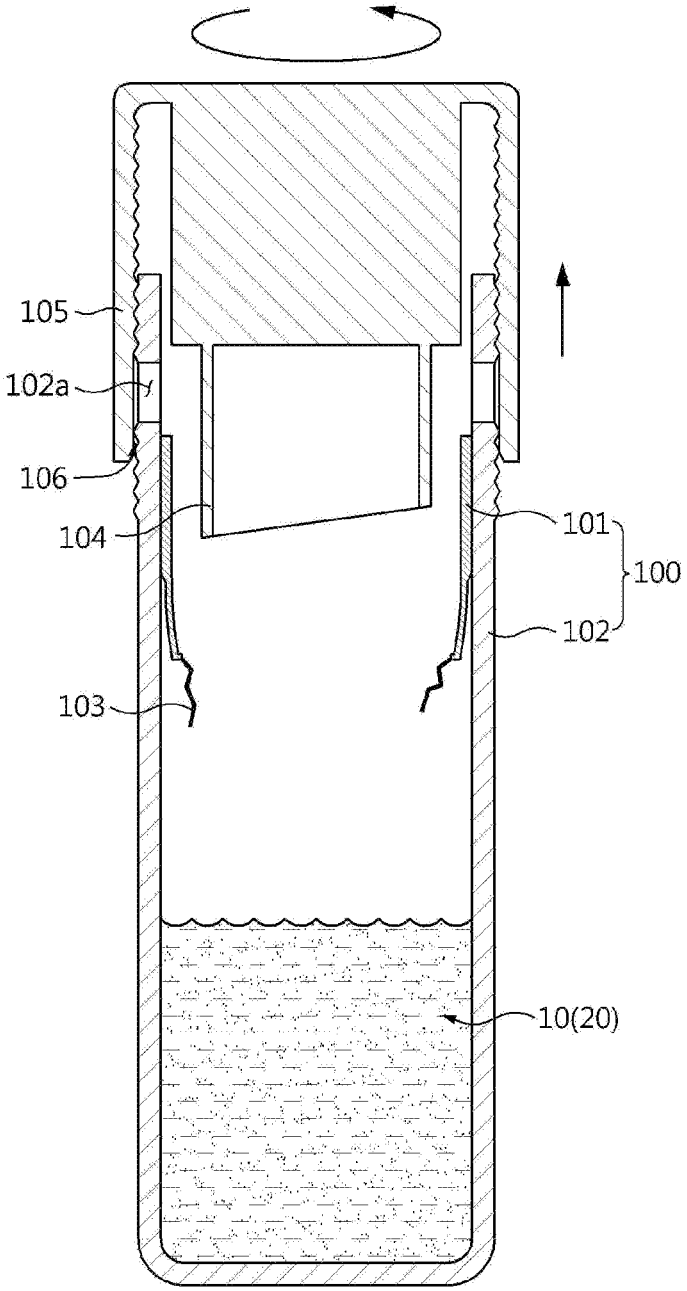

【FIG. 4】
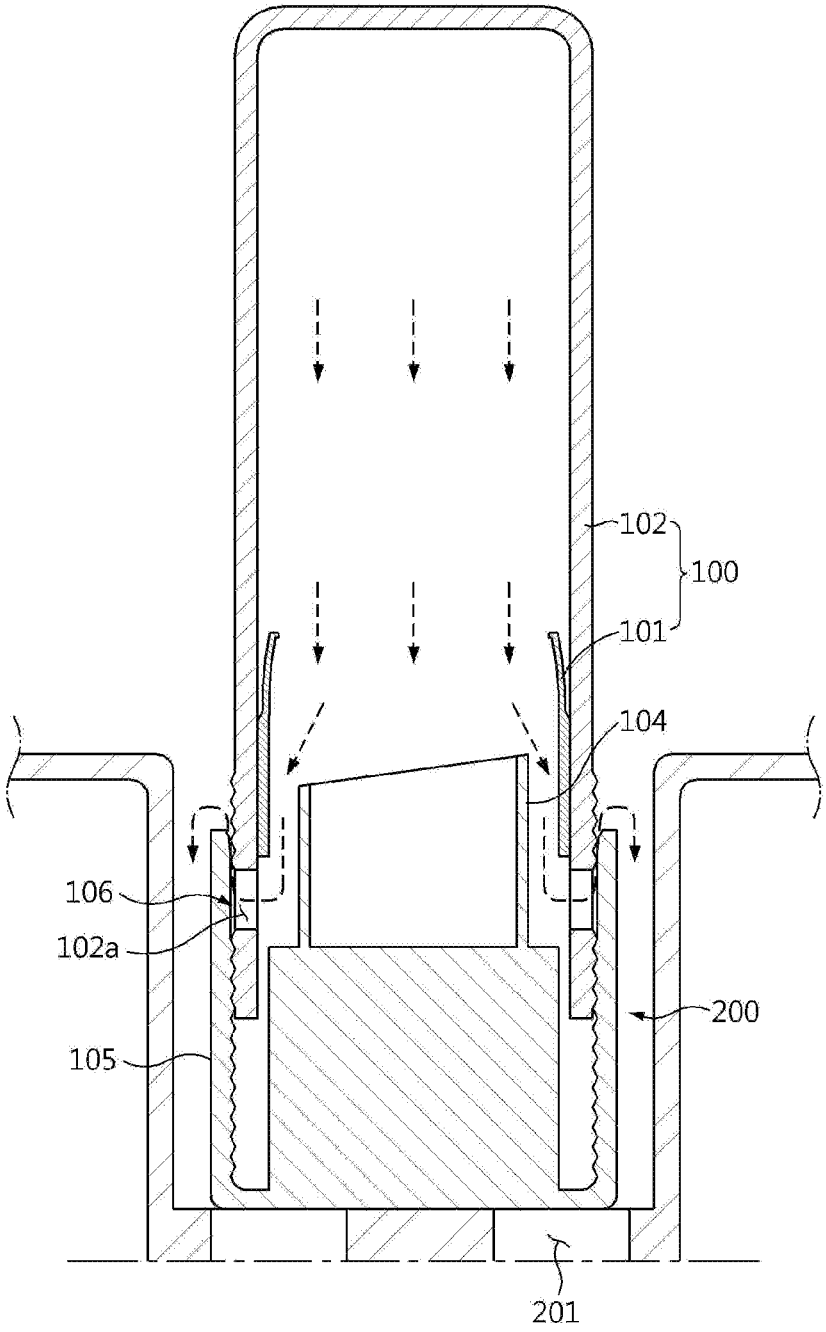

【FIG. 5】
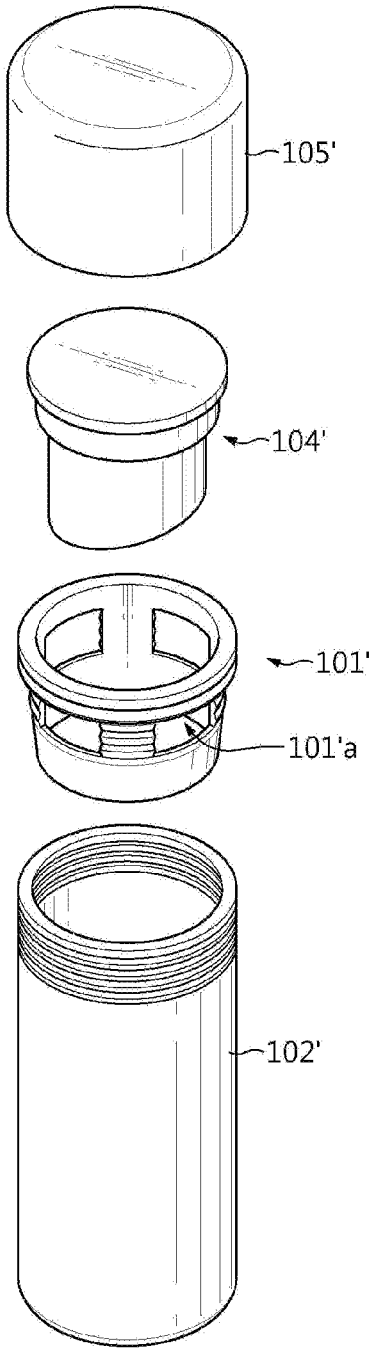

【FIG. 6】
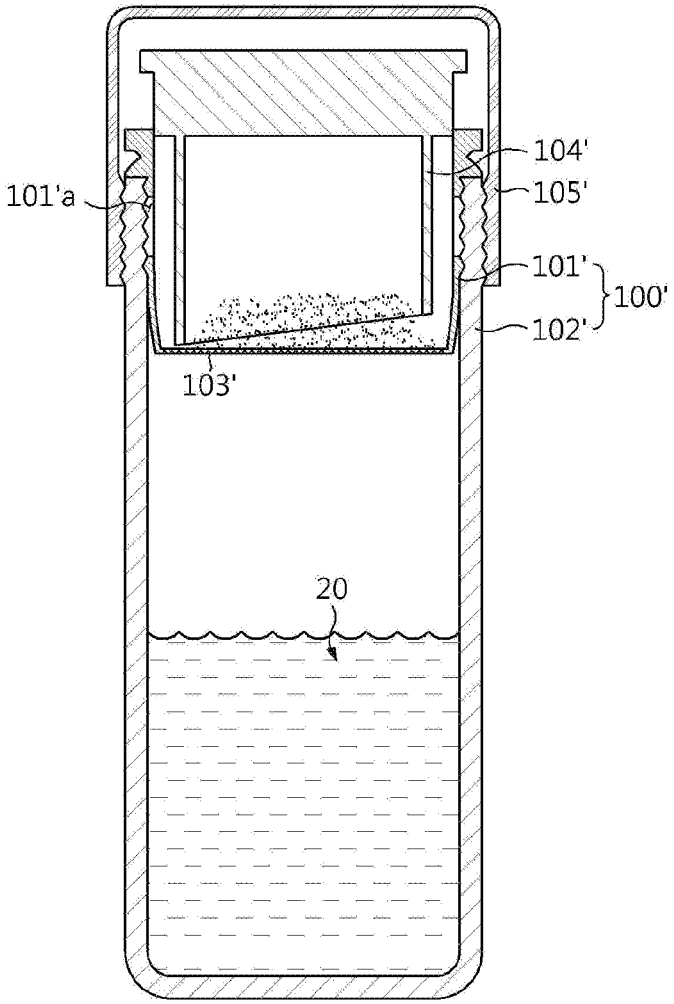

【FIG. 7】
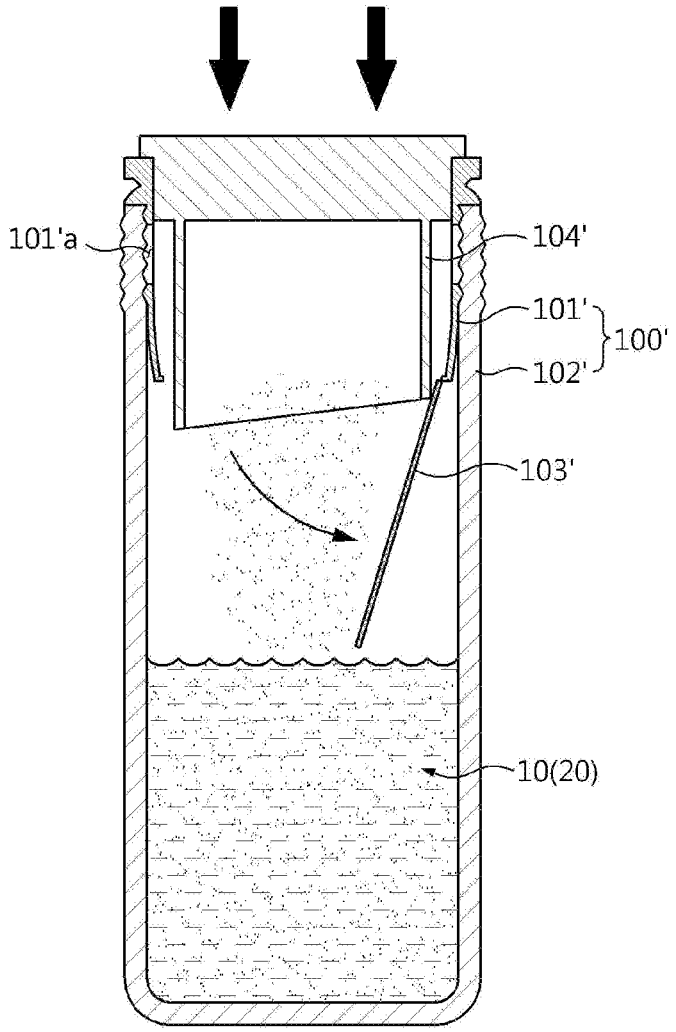

【FIG. 8】
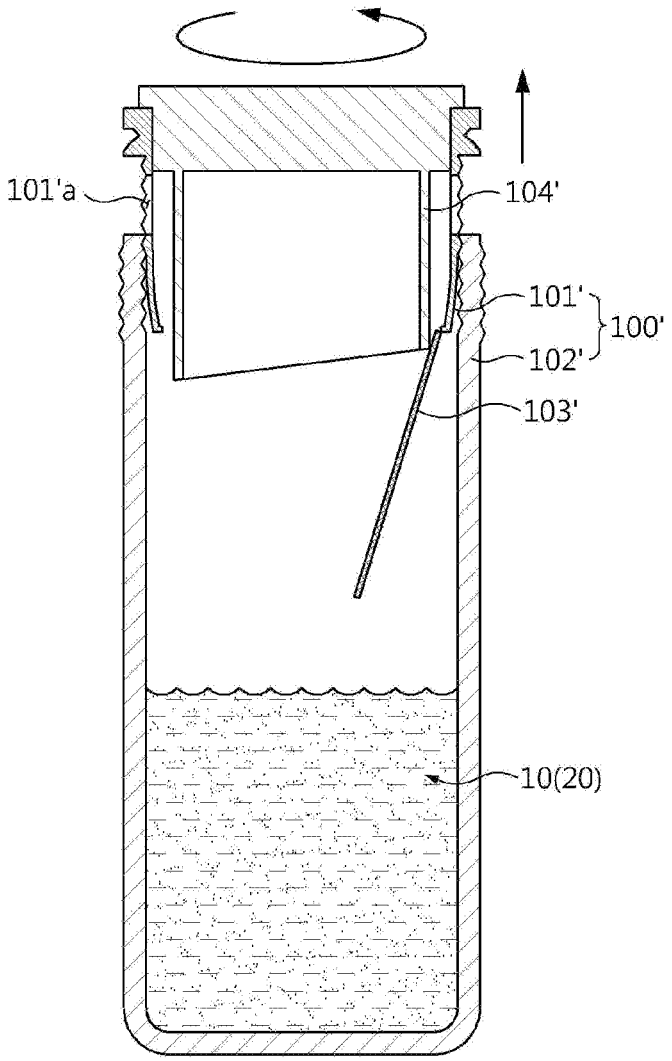

【FIG. 9】
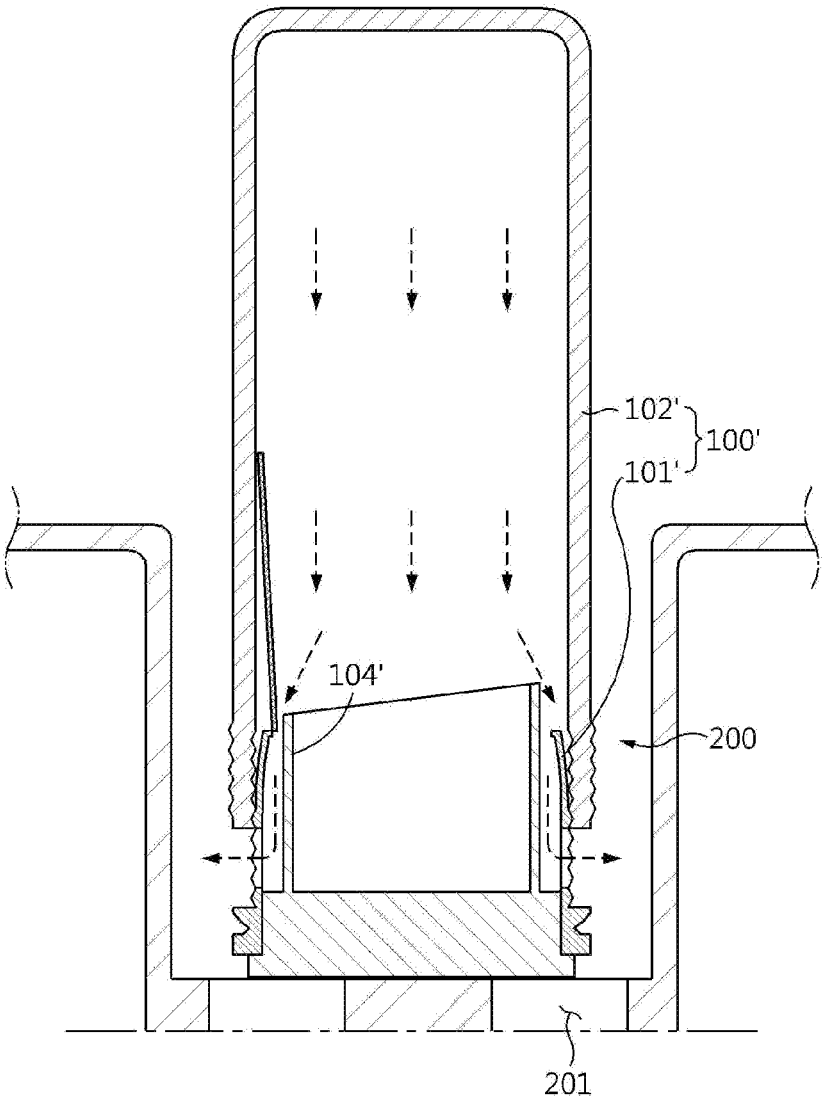

【FIG. 10】
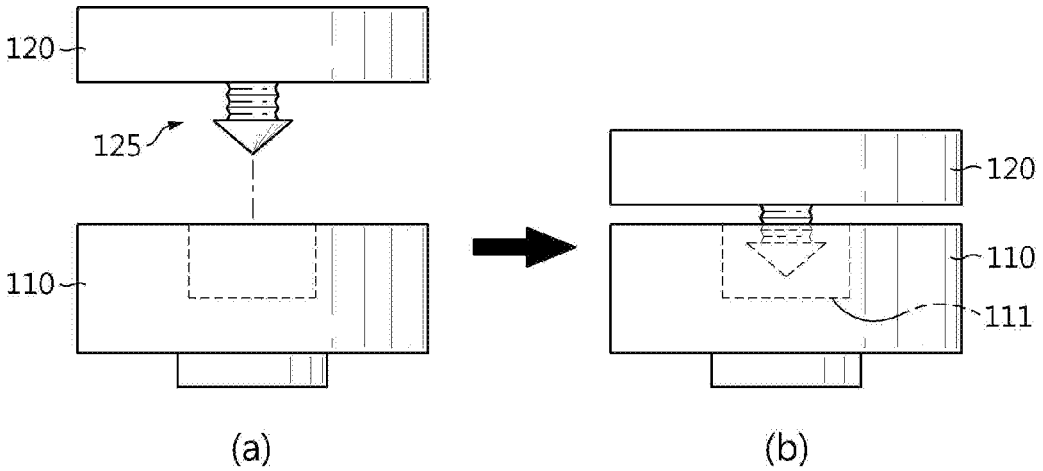
【FIG. 11】
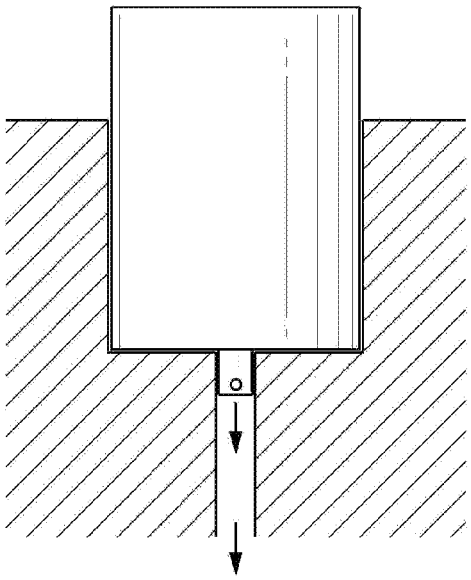

METHOD FOR CLEANING DRAIN PIPE OF SINK AND CLEANING CONTAINER THEREFOR

CROSS REFERENCE TO RELATED APPLICATIONS

This application is the National Phase of PCT International Application No. PCT/KR2018/013415, filed on Nov. 6, 2018, which claims priority under 35 U.S.C. 119(a) to Patent Application Nos. 10-2017-0146817, filed in the Republic of Korea on Nov. 6, 2017 and 10-2017-0147519, filed in the Republic of Korea on Nov. 7, 2017, all of which are hereby expressly incorporated by reference into the present application.

TECHNICAL FIELD

The present invention relates to an aerosol spray for cleaning a drain, and more specifically, relates to an aerosol spray for cleaning a drain with an excellent foam cleaning effect by spraying a drain cleaner composition into a sink drain and a drain pipe.

In addition, the present invention relates to a cleaning method of a drain of a sink and a cleaner container therefor, and more specifically, relates to a method for cleaning and sterilizing by injecting a mixed foam cleaner into a drain of a sink.

BACKGROUND ART

In general, the filter and drain of the sink are easily soiled and cause severe odors, as foods remain in the process of cooking or disposing of foods and they are always wet in water so it is an environment where microorganisms can easily grow. However, it is inconvenient and time-consuming and labor-intensive to clean them to keep the filter or drain clean, but there is no special alternative other than replacing the filter or drain, and therefore it is problematic.

To solve this, U.S. Patent Application No. 2014-529388 discloses a two liquid system for cleaning a pipe by foaming hydrogen peroxide with hydrolase such as amylase. However, this system has a disadvantage in that the sterilization bleaching effect of hydrogen peroxide is significantly lower than that of sodium hypochlorite and thus the sterilization bleaching effect is not sufficiently exhibited.

In addition, U.S. Patent Publication No. 2003-0171234 discloses a method for cleaning a pipe by pouring a sodium hypochlorite composition having viscosity and a foaming agent at the same time to foam. However, in this cleaning method, the sodium hypochlorite and foaming agent are difficult to be uniformly, and foam does not stay in the pipe of the vertically installed sink for a long time, but is released shortly, and therefore there is a limit to maintain the cleaning effect. Accordingly, there is a need to develop a composition or method capable of cleaning a sink drain more effectively, by increasing the duration of the cleaning effect of a foam cleaner composition.

DISCLOSURE

Technical Problem

A problem to be solved by the present invention is to provide an aerosol spray for cleaning a drain which can exhibit a foam cleaning effect by spraying it to a drain hole and a drain of a sink.

In addition, a problem to be solved by the present invention is to provide a method for foam cleaning of a drain hole and a drain of a sink using the aerosol spray for cleaning a drain.

Furthermore, a problem to be solved by the present invention is to provide a method for cleaning a drain of a sink, improved so as to mixing and foaming a cleaner conveniently using a combined structure of a first receiving part and a second receiving part to clean a drain of a sink, and a cleaner container therefor.

Moreover, a problem to be solved by the present invention is to provide a method for cleaning a drain of a sink which can increase the duration of a cleaning effect by a foam cleaner by allowing foam to stay in a pipe of a vertically installed sink for a long time, and a cleaner container therefor.

Technical Solution

In addition, as a result of earnest research efforts to overcome the problems of the prior art, the present inventors have found that when a drain cleaner composition is sprayed to a filter, a drain hole and a drain of a sink with an aerosol spray, the foamed cleaner composition stays in the filter, drain hole and drain for a long time, and therefore the cleaning effect is maximized, thereby completing the present invention.

The present invention provides an aerosol spray for cleaning a drain comprising a drain cleaner composition containing a chlorinated cleaner component. The aerosol spray has a very excellent cleaning effect, by spraying the drain cleaner composition to the drain hole and drain, thereby cleaning the filter, drain hole and drain for a long time. The aerosol spray of the present invention can spray the drain cleaner composition in an aerosol or foam form.

Herein, 'aerosol' may mean a system in which a small drop of liquid is dispersed in gas, by spraying a liquid drain cleaner composition enclosed with liquefied gas in a sealed container at a gas pressure.

Herein, the aerosol spray for cleaning a drain may use a container which injects a drain cleaner composition comprised inside of the container in an aerosol or foam form through a nozzle when opened. The container of the aerosol spray for cleaning a drain of the present invention may be prepared by filling a drain cleaner composition in an inner container which is flexible and can be sealed. The container of the aerosol spray may consist of an outer container made of iron, aluminum or plastic, or the like and an inner container comprising a drain cleaner composition. Between the outer container and inner container, LPG, DME, compressed nitrogen or compressed air, or the like, which allows to have pressure inside the container to spray a drain cleaner composition, may be filled. In the container of the aerosol spray, the top of the outer container may be sealed with a valve, and when the valve is opened and it is used, the drain cleaner composition in the inner container may be continuously injected for a predetermined time.

Herein, the chlorinated cleaner component may comprise hypochlorite, and it can be effectively used in cleaning, sterilizing and disinfecting of a filter, a drain hole and a drain of a sink, as it has excellent sterilizing and bleaching effects and it has a fast decomposition rate when diluted, and therefore it is less residual, and has low oral toxicity. More specifically, the hypochlorite may comprise one or more selected from the group consisting of sodium hypochlorite, potassium hypochlorite, calcium hypochlorite and magnesium hypochlorite, and the like, but not limited thereto. Preferably, as the chlorinated cleaner component, sodium hypochlorite may be used.

The chlorinated cleaner component, preferably, hypochlorite, may be used in an amount of 0.1~30% by weight, preferably, 5~27% by weight, more preferably, 15~25% by weight, based on the total weight of the composition. When the chlorinated cleaner component, preferably, hypochlorite is used less than 0.1% by weight, the function as a sterilizing or disinfecting agent is weak, and when it is used over 30% by weight, the compatibility with a surfactant is not good, and it is disadvantageous in the aspect of stability of the hypochlorite ion itself.

Herein, the cleaner composition may comprise an anionic surfactant, non-ionic surfactant, or a mixture thereof, for increasing the sterilizing or disinfecting power of the hypochlorite ion and enhancing the cleaning effect and viscosity. Preferably, the anionic surfactant may comprise alkyl ether sulfate of the following chemical formula 1, preferably, SLES (sodium lauryl ether sulfate).

$$R(CH_2CH_2O)_nSO_3M$$ [Chemical formula 1]

(The R represents an alkyl group of C10~C16, and n represents an integer of 1~5, and M represents sodium or potassium)

Preferably, the anionic surfactant may comprise a mixture of alkyl ether sulfate of the chemical formula 1 and alkyl amine oxide of the following chemical formula 2. Preferably, as the alkyl amine oxide of the following chemical formula 2, lauramine oxide may be used.

[Chemical 2]

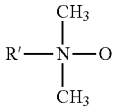

(The R'represents an alkyl group of C10~C16)

Herein, by using the mixture of the alkyl ether sulfate and alkyl amine oxide as an anionic surfactant, by the synergistic effect between surfactants and the interaction with hypochlorite, excellent cleaning power and viscosity can be formed than using each of them separately.

Preferably, the weight ratio of the alkyl ether sulfate and alkyl amine oxide may be 1:20 to 20:1, preferably, 1:10 to 10:1, more preferably 1:1 to 10:1 (alkyl ether sulfate:alkyl amine oxide). When the alkyl ether sulfate and alkyl amine oxide are used in the above weight ratio, the viscosity of the cleaner composition of the present invention can be formed most excellently.

Herein, the anionic surfactant, non-ionic surfactant, or mixture thereof may be comprised in an amount of 1~40% by weight, preferably, 3~30% by weight, more preferably, 5~20% by weight, based on the total weight of the cleaner. When the content of the surfactant is less than 1% by weight, the performance of the cleaner is weak, and when it is over 40% by weight, there is a problem in that the solubility of the cleaner is lowered.

The cleaner composition of the present invention may further comprise any components in a range that does not impair the object of the invention, and may further comprise a preservative, a thickener, and a viscosity adjusting agent, a flavoring agent or dye, or the like, which is usefully used in common for a cleaning composition to maintain basic physical properties and quality as a cleaner composition.

Herein, the drain cleaner composition may further comprise a flavoring agent additionally to reduce a strong odor of the hypochlorite ion when used and satisfy esthetic requirements. The flavoring agent may be used that is stable to hypochlorite ions, and it may be used in an amount of 0.01~2% by weight based on the total weight of the cleaner composition.

In addition, as the preservative, for example, the mixture of methyl p-hydroxybenzoate, methyl chloroisothiazolinone, and methyl isothiazolinone (product name: Kathon CG, manufacturing company: U.S. Rohm & Haas), and the like may be used. As the thickener and viscosity adjusting agent, hydroxy propyl methyl cellulose, hydroxy methyl cellulose, sodium chloride, ammonium chloride, propylene glycol or hexylene glycol, or the like may be used. As the dye, water-soluble tar color, and the like may be used.

Herein, the drain cleaner composition may further comprise a thickener to slow the flowing rate. The viscosity of the cleaner composition comprising the thickener may be 100~10,000 cps. The thickener may use for example, one or more kinds selected from the group consisting of acrylate polymer, xanthan gum, locust bean gum, carrageenan, pectin and gelatin, and the like, but not limited thereto.

The drain cleaner composition which can be used in the aerosol spray for cleaning a drain of the present invention may not comprise a foaming agent substantially. Preferably, the drain cleaner composition may comprise a foaming agent in an amount of less than 5% by weight, more preferably, less than 1% by weight, much more preferably, less than 0.1% by weight, based on the total weight of the composition, and most preferably, it may not comprise it. The aerosol spray for cleaning a drain of the present invention does not contain a foaming agent substantially, and therefore neutralization of the chlorinated cleaner composition is prevented, so that the cleaning power is not impaired. In addition, the aerosol spray for cleaning a drain of the present invention exhibits a sufficient foaming effect just by spraying, and there is no unnecessary foaming process by a foaming agent, and therefore the loss of the cleaning component can be minimized.

Herein, the aerosol spray for cleaning a drain may use a container which injects a drain cleaner composition comprised inside of the container with a specific pressure when opened in an aerosol or foam form through a nozzle. Preferably, the aerosol spray for cleaning a drain of the present invention may be prepared so that the drain cleaner composition inside of the container is continuously sprayed for a certain time until it runs out when opened.

The aerosol spray of the present inventio may be prepared as the compressive force of the container is 3 to 9 bars, preferably, 4 to 7 bars. When the compressive force of the aerosol spray container is less than 3 bar, the discharging force of the cleaner composition is insufficient, and therefore the cleaning force is weak, and when it is over 9 bar, the cleaner composition is discharged dramatically, and thus there is a problem in that the duration of cleaning is reduced.

Preferably, the nozzle of the container of the aerosol spray of the present invention may be combined with the inlet of the drain hole. When using this type of aerosol spray, the foam cleaner composition discharged from the spray is allowed to remain in the drain hole and drain without overflowing, thereby cleaning the drain hole and drain for a predetermined time effectively.

Regarding the predetermined time, the aerosol spray of the present invention may adjust the discharging amount and discharging time of the foam cleaner composition, by controlling the valve and nozzle of the container. The discharging time of the aerosol spray of the present invention may be adjusted so as to discharge the cleaner composition for about 1 to 10 minutes, preferably, 1.5 to 8 minutes, more preferably, 2 to 5 minutes. When the discharging time is less than 1 minute, the foamed cleaner composition may be insufficient to fill the drain hole and drain, and when it is over 10 minutes, the cleaner composition may be discharged in an excessive amount unnecessarily.

To exhibit the cleaning effect sufficiently, the discharged foamed cleaner composition may be left in the drain hole and drain for 10 minutes to 180 minutes, preferably, 20 minutes to 150 minutes, more preferably, 30 minutes to 120 minutes. When the leaving time of the cleaner composition of the spray is less than 10 minutes, the cleaner composition cannot stay for a long time, and therefore the cleaning effect is weak, and when it is over 180 minutes, problems such as generation of chlorine gas or corrosion of the sink may occur due to unnecessary increase of the cleaning time.

In addition, the present invention provides a method for cleaning a drain hole and a drain using the aerosol spray for cleaning a drain.

Preferably, the method for cleaning of the present invention may allow a cleaner to be discharged for a predetermined time, by combining the aerosol spray for cleaning a drain with the inlet of the drain (FIG. 10). In the method for cleaning, the predetermined time may be applied as same as contents for the aerosol spray of the present invention. When using this method, compact foam can be produced than a method for pouring a first agent and a second agent to foam, and when the cleaner composition in the spray is sprayed, the foamed cleaner can be pushed through a high pressure so as to sufficiently fill the drain. Through this, the method for cleaning of the present invention allows the cleaner composition to stay in the drain hole and drain for a long time without overflowing, and can maximize the cleaning effect for the drain hole and drain.

Furthermore, to achieve the above objects, the present invention provides a method for cleaning a drain of a sink comprising; (a) preparing a cleaner container comprising a first receiving part and a second receiving part in which a first agent and a second agent are received respectively; (b) mixing the first agent and the second agent each other; and (c) arranging the cleaner container to a drain inlet of a sink to inject a mixed foam cleaner released through an outlet of the cleaner container to the drain.

The step (a) may prepare a cleaner container in which the first receiving part and the second receiving part in which the first agent and the second agent are received separately each other are combined, and in the step (b), the first agent and the second agent may be mixed each other by damaging the isolating part between the first receiving part and the second receiving part by applying a physical force.

The step (b) may mix the first agent and the second agent each other, as the isolating part is ruptured by a physical force according to screw coupling or push operation.

In the step (a), the first receiving part and the second receiving part may be isolated each other, and in the step (b), the first agent and the second agent may be mixed each other together with combination between the first receiving part and the second receiving part.

Any one of the first agent and the second agent may be made of powder, and the other may be made of liquid.

The step (C) may arrange the cleaner container upside down to inject the mixed foam cleaner to the drain.

According to other aspect of the present invention, a cleaner container for cleaning a drain, which comprises; a first receiving part and a second receiving part receiving a first agent and a second agent respectively; and a rupturing part which is equipped in any one of the first receiving part and the second receiving part, and ruptures the isolating part to mix the first agent and the second agent when a physical force is applied as the first receiving part and the second receiving part are combined each other, and the complex of the first receiving part and the second receiving part is arranged in a drain inlet of a sink, to inject a mixed foam cleaner according to mixing the first agent and the second agent to the drain, is provided.

In one example, the cleaner container for cleaning a drain comprising the first receiving part and the second receiving part and the method for cleaning a drain using the same of the present invention may be used by mixing the first agent and the second agent and then spraying through the aerosol spray for cleaning a drain of the present invention when used.

ADVANTAGEOUS EFFECTS

The aerosol spray for cleaning a drain of the present invention can maximize a cleaning effect by spraying a drain cleaning composition in an aerosol or foam form to a filter, a drain hole and a drain of a sink so that a foamed cleaner stays for a long time.

In addition, according to the present invention, a first agent and a second agent can be conveniently mixed and foamed using a combined structure between a first receiving part and a second receiving part, and therefore there is an advantage of convenient handling and use.

Furthermore, the duration of the cleaning effect can be increased by allowing foam to stay in a drain of a sink for a long time, as a mixed foam cleaner can be slowly released from a cleaner container placed upside down.

BRIEF DESCRIPTION OF THE DRAWINGS

FIG. 1 is a combined cross-sectional diagram showing the configuration of the cleaner container for performing the method for cleaning a drain of a sink according to a preferable example of the present invention.

FIG. 2 is a cross-sectional diagram showing the ruptured isolating part in FIG. 1.

FIG. 3 is a cross-sectional diagram showing the example of the formed passage for release of a mixed foam cleaner in FIG. 2.

FIG. 4 is a cross-sectional diagram showing the example of installing the cleaner container of FIG. 3 in a drain of a sink.

FIG. 5 is a disassembled perspective view showing the configuration of the cleaner container for performing the method for cleaning a drain of a sink according to another example of the present invention.

FIG. 6 is a combined cross-sectional diagram of FIG. 5.

FIG. 7 is a cross-sectional diagram showing the ruptured isolating part in FIG. 6.

FIG. 8 is a cross-sectional diagram showing the example of the formed passage for release of a mixed foam cleaner in FIG. 7.

FIG. 9 is a cross-sectional diagram showing the example of installing the cleaner container of FIG. 8 in a drain of a sink.

FIG. 10 is side view before and after combining of the cleaner container for performing the method for cleaning a drain of a sink according to other example of the present invention.

FIG. 11 shows the method for using the aerosol spray for cleaning a drain of the present invention by spraying it to a drain hole and a drain of a sink, which is the method for spraying a cleaner after the aerosol spray container is reversed and fixed to the inlet of the drain.

BEST MODE

Hereinafter, the present invention will be described in detail by examples to help understanding of the present invention. However, the examples according to the present invention can be modified in many different forms, and the scope of the present invention should not be interpreted as being limited by the following examples. The examples of the present invention are provided to more fully describe the present invention to those skilled in the art.

EXAMPLE

Preparation of a Drain Cleaner Composition Used in an Aerosol Spray

A drain cleaner composition used in an aerosol spray was prepared by mixing components of raw materials in the composition ratio shown in the following Table 1.

TABLE 1

| | Raw material name | Weight ratio |
|---|---|---|
| 1 | Purified water | To 100 |
| 2 | Sodium hypochlorite (12%) | 20% |
| 3 | SLES (3 mol, 27%) | 5% |
| 4 | Lauramine oxide | 1% |
| 5 | Flavoring agent | 0.1% |

The drain cleaner composition was filled in a container with a pressure of 5 bar together with a compressed gas to prepare an aerosol spray. In the following experimental example, the comparative example had the same components as the example, but it was used as a liquid composition not an aerosol formulation.

Experimental Example

Drain Sterilizing Power and Cleaning Power Evaluation 10 households were visited and the sink drain was cleaned using the aerosol spray for cleaning a drain of the present invention. Specifically, the aerosol spray can of the present invention was placed upside down and combined to a drain, and the cleaner composition was sprayed for about 2~5 minutes, and then it was left for about 1.5 hours for the cleaning effect. After the cleaning treatment, the number of microorganisms in the filter and drain hole was evaluated. The number of microorganisms was measured 15 cm below the drain from the inlet of the drain.

The example that was the aerosol formulation was slowly discharged in a foam form, thereby exhibiting an excellent sterilizing power of 99.9% or higher in both filter and drain. On the other hand, the comparative example that was the liquid formulation could not stay in the filter and drain for a long time, and flowed down shortly, thereby exhibiting the insufficient sterilizing power.

TABLE 2

| | Formulation | Filter sterilizing power (%) | Drain sterilizing power (%) |
|---|---|---|---|
| Example 1 | Aerosol | 99.95 | 99.97 |
| Example 2 | Aerosol | 99.91 | 99.96 |
| Example 3 | Aerosol | 99.93 | 99.99 |
| Example 4 | Aerosol | 99.98 | 99.99 |
| Example 5 | Aerosol | 99.95 | 99.98 |
| Comparative example 1 | Liquid | 58.65 | 78.45 |
| Comparative example 2 | Liquid | 66.14 | 75.14 |
| Comparative example 3 | Liquid | 67.54 | 76.54 |
| Comparative example 4 | Liquid | 61.99 | 76.32 |
| Comparative example 5 | Liquid | 60.24 | 75.22 |

In addition, FIG. 1 is a combined cross-sectional diagram showing the configuration of the cleaner container for performing the method for cleaning a drain of a sink according to a preferable example of the present invention.

Referring to FIG. 1, the cleaner container provided according to the preferable example of the present invention comprises a container body (100) in which a first receiving part (101) and a second receiving part (102) are combined each other, and an isolating part (103) positioned between the first receiving part (101) and the second receiving part (102), and a cap (105) capping an opening by screw coupling on the top of the container body (100), and a rupturing part (104) rupturing the isolating part (103) by a physical force according to screw coupling of the cap (105).

In the container body (100), the first receiving part (101) and the second receiving part (102) which receive a first agent (10) and a second agent (20) respectively are combined each other to form one body as a whole. It is obvious that the shape of the container body (100) is not limited to the example shown in the drawing, and it can be variously modified.

The first receiving part (101) receiving the first agent (10) is positioned relatively closer to the top of the container body (100) compared to the second receiving part (102) receiving the second agent (20). The first receiving part (101) is preferable to be inserted inside the second receiving part (102) and fixed. In this arrangement, it is preferable that the first agent (10) is made of powder, and the second agent (20) is made of liquid, but it is obvious that it is not limited to this example. In other words, the first agent (10) and the second agent (20) may be provided in various forms selected from liquid, powder, tablets, and the like. The first agent (10) and the second agent (20) form a foam cleaner capable of cleaning and sterilizing a drain of a sink when mixed. As the composition of the first agent (10) and the second agent (20), a conventional product can be adopted, so detailed description thereof will be omitted.

On the side of the point (preferably, part in which screw is formed) close to the top of the second receiving part (102), a hole shape of outlet (102*a*) for release of a foam cleaner is formed. This outlet (102*a*) is communicated with a gap (106) which can release a mixed foam cleaner as the cap (105) is released from the second receiving part (102) and is exposed when it rises by a certain distance.

The isolating part (103) is positioned between the first receiving part (101) and the second receiving part (102) to isolate the first agent (10) and the second agent (20) each other. The isolating part (103) may be made of other member from the first receiving part (101) or second receiving part (102) (for example, thin film), and it is possible to be provided by the bottom part of the first receiving part (101).

The rupturing part (104) is to be communicated by being integrated with the certain form of cap (105). As shown in FIG. 2, the rupturing part (104) ruptures the isolating part (103) while rotating by a physical force as the cap (105) moves forward to the bottom by screw coupling to the container body (100), and accordingly, the first agent (10) and the second agent (20) are mixed each other. The end of the rupturing part (104) is configured in a substantially pointed or sharp shape to rupture the isolating part (103). It is preferable that the rupturing part (104) is configured in a cylinder shape to rupture the isolating part (103) over a large area as much as possible, and one side is formed relatively longer to form a sharp structure. As an alternative, it is possible that the rupturing part (104) is configured in a bar form with a pointed end.

As shown in FIG. 3, the gap (106) communicated with the outside may be formed between the cap (105) and the second receiving part (102), in the state that the cap (105) is reversed in a certain distance on the contrary. Accordingly, the mixed foam cleaner according to mixing of the first agent (10) and the second agent (20) may be slowly released outside the container body (100) through the gap (106).

The cleaner container having the above configuration, releases isolation between the first agent (10) and the second agent (20), as the rupturing part (104) moves forward as a user intentionally turns the cap (105) in the direction of locking to rupture the isolating part (103). When the isolating part (103) is ruptured, the powdered first agent (10) in the first receiving part (101) and the liquid second first agent (20) in the second receiving part (102) are mixed each other to form a foam cleaner.

After the foam cleaner is made by mixing of the first agent (10) and the second agent (20), when the cap (105) is slightly rotated in the opening direction, the mixed foam cleaner is converted into a state in which external release is possible through the outlet (102*a*) and the gap (106) between the container body (100) and the cap (105) communicated thereto.

In a state in which external release of the mixed foam cleaner is possible, when the cleaner container is arranged upside down to the drain inlet (200) of the sink as shown in FIG. 4, the mixed foam cleaner is slowly injected through an inlet hole (201) of the drain over a long time to perform cleaning and sterilizing treatments.

FIG. 5 a disassembled perspective view showing the configuration of the cleaner container for cleaning a drain of a sink according to another example of the present invention, and FIG. 6 is a combined cross-sectional diagram of FIG. 5.

Referring to FIG. 5 and FIG. 6, the cleaner container provided according to another example of the present invention comprises a container body (100') in which a first receiving part (101') and a second receiving part (102') are combined each other, and an isolating part (103') positioned between the first receiving part (101') and the second receiving part (102'), and a cap (105') capping an opening by screw coupling on the top of the container body (100'), and a rupturing part (104') rupturing the isolating part (103') by a physical force according to push operation of a user.

The first receiving part (101') is positioned relatively closer to the top of the container body (100') compared to the second receiving part (102'). For this, it is preferable that the first receiving part (101') is inserted to the top of the second receiving part (102') by screw coupling. It is preferable that a hole shape of outlet (101'*a*) for release of a mixed foam cleaner is formed on the side of the first receiving part (101'). This outlet (101'*a*) is communicated with the outside when the first receiving part (101') is released from the second receiving part (102') and rises by a certain distance.

It is preferable that the first agent (10) received in the first receiving part (101') is made of powder, and the second agent (20) received in the second receiving part (102') is made of liquid, but it is obvious that it is not limited to this example. In other words, the first agent (10) and the second agent (20) may be provided in various forms selected from liquid, powder, tablets, and the like. The first agent (10) and the second agent (20) form a foam cleaner capable of cleaning and sterilizing a drain of a sink when mixed. As the composition of the first agent (10) and the second agent (20), a conventional product can be adopted, so detailed description thereof will be omitted.

The isolating part (103') is positioned between the first receiving part (101') and the second receiving part (102') to isolate the first agent (10) and the second agent (20) each other. The isolating part (103') may be made of other member from the first receiving part (101') or second receiving part (102') (for example, thin film), and it is possible to be provided by the bottom part of the first receiving part (101').

The rupturing part (104') is separated from the cap (105'), and is combined to the first receiving part (101') as to be a little bit tightly fitted. As shown in FIG. 7, when an external force is applied to the top of the rupturing part (104') while the cap (105') is removed, the rupturing part (104') slides downward of the first receiving part (101') to moves forward. By the physical force according to this, the rupturing part (104') ruptures the isolating part (103') and as the isolation is released, the first agent (10) and the second agent (20) are mixed each other. The end of the rupturing part (104') is configured in a substantially pointed or sharp shape to rupture the isolating part (103'). It is preferable that the rupturing part (104') is configured in a cylinder shape to rupture the isolating part (103') over a large area as much as possible, and one side is formed relatively longer to form a sharp structure. As an alternative, it is possible that the rupturing part (104') is configured in a bar form with a pointed end.

As shown in FIG. 8, the outlet (101'*a*) is exposed to the outside when the screw of the first receiving part (101') is loosened, and it escapes from the second receiving part (102') by a certain distance. Accordingly, the container body (100') may be communicated with the outside. Thus, the mixed foam cleaner according to mixing of the first agent (10) and the second agent (20) may be slowly released outside the container body (100') through the outlet (101'*a*).

The cleaner container having the above configuration, releases isolation between the first agent (10) and the second agent (20), as the rupturing part (104') moves forward as a user conducts push operation for the top of the rupturing part (104') in the state in which the cap (105') is removed, to rupture the isolating part (103'). When the isolating part (103') is ruptured, the powdered first agent (10) in the first receiving part (101) and the liquid second first agent (20) in the second receiving part (102) are mixed each other to form a foam cleaner.

After the foam cleaner is made by mixing of the first agent (10) and the second agent (20), the mixed foam cleaner is converted into a state in which external release is possible as the mixed foam cleaner escapes from the container body (100') by turning the first receiving part (101') in the opening direction and slightly exposing the outlet (102') to the outside.

In a state in which external release of the mixed foam cleaner is possible, when the cleaner container is arranged upside down to the drain inlet (200) of the sink as shown in FIG. 9, the mixed foam cleaner is slowly injected through an inlet hole (201) of the drain over a long time to perform cleaning and sterilizing treatments.

FIG. 10 shows the combined structure of the cleaner container for performing the method for cleaning a drain of a sink according to other example of the present invention.

In the (a) of FIG. 10, a first receiving part (110) and a second receiving part (120) receive the first agent and the second agent separately as same as the aforementioned example, and they are provided as separated each other.

When using, as shown in the (b) of FIG. 10, when the second receiving part (120) is combined to the first receiving part (110) and the combination is completed, an isolating part (111) of the first receiving part (110) is ruptured by a rupturing part (125) equipped in the second receiving part (120), and thereby the first receiving part (110) and the second receiving part (120) are communicated each other to mix the first agent and the second agent each other, and thereby a foam cleaner is formed. Then, the isolating part (111) of the first receiving part (110) may be ruptured as the rupturing part (125) of the second receiving part (120) is inserted to the first receiving part (110) by a physical force by screw coupling or push operation. As an alternative, a certain isolating part (isolation film) is prepared at the end of the second receiving part (120) and is ruptured by being damaged during the insertion process, so that the second agent is released inside of that, and thereby it may be mixed with the first agent received in the first receiving part (110).

In a state in which the first receiving part (110) and the second receiving part (120) are combined, when the cleaner container is placed in the drain inlet (200) of the sink, the mixed foam cleaner is slowly discharged through a gap between the first receiving part (110) and the second receiving part (120) over a long time and is injected through an inlet hole (201) of the drain to perform cleaning and sterilizing treatments.

In the above, although the present invention is described with limited examples and drawings, the present invention is not limited by them, and it is obvious that various modifications and variations are possible within the scope of the technical idea and claims to be described below by those skilled in the art to which the present invention pertains.

DESCRIPTION OF REFERENCE NUMERALS

| | |
|---|---|
| 10: First agent | 20: Second agent |
| 100, 100': Container body | 101, 101', 110: First receiving part |
| 102, 102', 120: Second receiving part | 101'a, 102a: Outlet |
| 103, 103', 111: Isolating part | 104, 104', 125: Rupturing part |
| 105, 105': Cap | 106: Gap |
| 200: Drain inlet | |

The invention claimed is:

1. A method for cleaning a drain of a sink comprising:

(a) preparing a cleaner container, the cleaner container including:

a container body including a first receiving part and a second receiving part in which a first agent and a second agent are received respectively, wherein the first receiving part and the second receiving part are provided separated from each other and the second receiving part includes:

screw threads on an outer surface of the second receiving part; and an outlet formed between at least one of the screw threads;

an isolating part between the first receiving part and the second receiving part for isolating the first receiving part from the second receiving part; and a cap including a rupturing part extending along an axial direction of the container body towards the isolating part, the cap threadingly engaging the container body to seal the container body;

(b) rotating the cap in a first direction with respect to the container body, causing the cap to engage more threads of the second receiving part to cause the rupturing part to rupture the isolating part to mix the first agent with the second agent, forming a foam cleansing agent; then (c) rotating the cap in a second direction, opposite to the first direction, to loosen the cap; and then (d) arranging the cleaner container having the cap threadingly engaged with the container body in a drain inlet of the sink such that the foam cleansing agent is released through the outlet of the second receiving part into the sink to clean the drain of the sink.

2. The method for cleaning a drain of a sink according to claim 1, wherein any one of the first agent and the second agent is made of powder and the other is made of liquid.

3. The method for cleaning a drain of a sink according to claim 1, wherein the rotation the cap in the second direction creates a space between the threads of the second receiving part and the cap, and wherein the foaming agent is released through the outlet of the second receiving part and through the space between the threads of the second receiving part and the cap.

4. The method for cleaning a drain of a sink according to claim 2, wherein in the step (d), the cleaner container is arranged upside down to inject the mixed foam cleaner to the drain.

5. A method for cleaning a drain of a sink comprising:

(a) preparing a cleaner container, the cleaner container including:

a container body including a first receiving part and a second receiving part in which a first agent and a second agent are received respectively, wherein the first receiving part and the second receiving part are provided separated from each other and the first receiving part includes:

screw threads on an outer surface of the first receiving part; and an outlet formed between at least one of the screw threads;

an isolating part between the first receiving part and the second receiving part for isolating the first receiving part from the second receiving part;

a cap, the cap threadingly engaging the container body to seal the container body; and a rupturing part extending along an axial direction of the container body towards the isolating part;

(b) rotating the cap with respect to the container body to remove the cap from the container body;

(c) applying an external force to a top surface of the rupturing part to cause the rupturing part to rupture the isolating part to mix the first agent with the second agent, forming a foam cleansing agent;

(d) rotating the first receiving part relative to the second receiving part to loosen the first receiving part; and then (e) arranging the cleaner container in a drain inlet of the sink such that the foam cleansing agent is released through the outlet of the first receiving part into the sink to clean the drain of the sink.

6. The method for cleaning a drain of a sink according to claim 5, wherein any one of the first agent and the second agent is made of powder and the other is made of liquid.

7. The method for cleaning a drain of a sink according to claim 5, wherein the rotation of the first receiving part relative to the second receiving part exposes the outlet of the first receiving part to the outside.

8. The method for cleaning a drain of a sink according to claim 6, wherein in the step (e), the cleaner container is arranged upside down to inject the mixed foam cleaner to the drain.

9. A method for cleaning a drain of a sink comprising:

(a) preparing a cleaner container, the cleaner container including:

a container body including a first receiving part and a second receiving part in which a first agent and a second agent are received respectively, wherein the first receiving part and the second receiving part are provided separated from each other and the second receiving part includes:

screw threads on an outer surface of the second receiving part; and an outlet formed on a side of the second receiving part, between at least one of the screw threads, or above the screw threads;

an isolating part between the first receiving part and the second receiving part for isolating the first receiving part from the second receiving part; and a cap including a rupturing part extending along an axial direction of the container body towards the isolating part, the cap threadingly engaging the container body;

(b) rotating the cap with respect to the container body, causing the rupturing part to rupture the isolating part to mix the first agent with the second agent, forming a foam cleansing agent; and then (c) arranging the cleaner container upside down in a drain inlet of the sink such that the foam cleansing agent is released through the outlet of the second receiving part into the sink to clean the drain of the sink.

10. The method for cleaning a drain of a sink according to claim 9, wherein any one of the first agent and the second agent is made of powder and the other is made of liquid.

* * * * *